US009170015B2

(12) United States Patent
Lu et al.

(10) Patent No.: US 9,170,015 B2
(45) Date of Patent: Oct. 27, 2015

(54) HEAT DISSIPATION STRUCTURE OF LIGHTING DEVICES

(71) Applicant: TCY-TEC Corporation, Taipei (TW)

(72) Inventors: Hung-Chih Lu, Taoyuan County (TW); Chung-Pin Yang, Taipei (TW)

(73) Assignee: CY-D ENGINEERING CO., LTD., Taipei (TW)

( * ) Notice: Subject to any disclaimer, the term of this patent is extended or adjusted under 35 U.S.C. 154(b) by 0 days.

(21) Appl. No.: 14/288,746

(22) Filed: May 28, 2014

(65) Prior Publication Data

US 2015/0159855 A1 Jun. 11, 2015

(30) Foreign Application Priority Data

Dec. 11, 2013 (TW) ..... 102223396 U

(51) Int. Cl.

| | |
|---|---|
| ***F21V 29/87*** | (2015.01) |
| ***F21V 29/503*** | (2015.01) |
| ***F21K 99/00*** | (2010.01) |
| *F21Y 101/02* | (2006.01) |

(52) U.S. Cl.

CPC ..... *F21V 29/87* (2015.01); *F21K 9/1355* (2013.01); *F21V 29/503* (2015.01); *F21Y 2101/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 2011/0046027 | A1* | 2/2011 | Zhamu et al. | 508/113 |
| 2011/0169394 | A1* | 7/2011 | Chowdhury et al. | 313/46 |

* cited by examiner

*Primary Examiner* — Thomas M Sember
(74) *Attorney, Agent, or Firm* — Jackson IPG PLLC; Demian K. Jackson

(57) ABSTRACT

A heat dissipation structure of lighting devices is disclosed, which comprises a light emitting mechanism; a carbon nanoparticles which have hexagonal carbon ring geometry based heat dissipation unit, combined with an end of the light emitting mechanism; and a socket, electrically connected to the light emitting mechanism, and combined with an end of the carbon nanoparticles which have hexagonal carbon ring geometry based heat dissipation unit. As such, a thermal transmission efficiency is promoted, a thermal transfer bottleneck is effectively decreased, heat sink is never necessary, a heat dissipation cost is largely reduced, a volume and weight of the device is reduced, and a waste of the raw material, carbon, and energy consumption can be reduced.

7 Claims, 6 Drawing Sheets

HEAT DISSIPATION STRUCTURE OF LIGHTING DEVICES

FIELD OF THE INVENTION

The present invention relates to a heat dissipation lighting structure, and particularly to a heat dissipation lighting structure, where a carbon nanoparticles which have hexagonal carbon ring geometry based heat dissipation unit is used to absorb the heat generated from a heat source when a light emitting mechanism operates, and the heat source is directly and effectively transfer to the ambient, avoiding a huge thermal resistances for the thermal path form heat source to the ambient, so that a thermal transmission effectiveness is promoted, a thermal transfer bottleneck Is effectively reduced, heat sink is never necessary, a heat dissipation cost is largely reduced, a volume and weight is reduced, a consumption of the raw material is reduced, and a purpose of energy saving and carbon reduction is achieved.

FIELD OF THE INVENTION

Generally, LED bulbs typically have heat be generated when being used. It usually has heat sink disposed at a middle part of the LED bulbs to dissipate the heat from LED lamp beads.

However, heat transfer has its bottleneck and barrier not owing to an interface between the heat source and the heat dissipation body but an interface between the heat dissipation body and the ambient. Since there is a very huge thermal transfer gap at the interface between the heat dissipation body and the ambient (like as air), i.e. the heat dissipation body has a large thermal transfer efficiency while the air has a small thermal transfer efficiency, a thermal backflow is generated along a thermal path when the heat is transferred to between the heat dissipation body and the air through the thermal path in the heat sink, although the prior art heat dissipation is used in an attempt to promote the thermal transfer efficiency. Thus, the bottleneck and barrier of thermal transfer are formed. In addition, the heat sink may also increase the heat dissipation cost, increase the volume and weight of the apparatus, and waste the raw material, except for the above mentioned disadvantages.

In view of the drawbacks mentioned above, the inventor of the present invention provides a heat dissipation structure of lighting devices, after many efforts and researches to overcome the shortcoming encountered in the prior art.

SUMMARY OF THE INVENTION

It is a main object of the present invention to greatly transfer the heat form a heat source when a light emitting mechanism operates by using a carbon nanoparticles which have hexagonal carbon ring geometry based heat dissipation unit and directly and effectively guide the heat source to ambient to avoid a thermal transfer gap from generating when the heat dissipation occurs with respect to ambient. As such, a thermal transmission efficiency is promoted, a thermal transfer bottleneck is effectively decreased, heat sink is not necessary, a heat dissipation cost is largely reduced, a volume and weight of the device is reduced, and a waste of the raw material, and carbon and energy consumption can be reduced.

To achieve above purpose, the heat dissipation structure of lighting devices according to the present invention comprises a light emitting mechanism; a driver; a carbon nanoparticles which have hexagonal carbon ring geometry based heat dissipation unit, combined with an end of the light emitting mechanism; and a socket, electrically connected to the light emitting mechanism, and combined with an end of the carbon nanoparticles which have hexagonal carbon ring geometry based heat dissipation unit.

In above embodiment, the light emitting mechanism comprises a light emitting body electrically connected to the socket through a driver, and a lampshade enclosing the light emitting body.

In above embodiment, the light emitting body is a light source module.

In above embodiment, the light emitting body is a light source module having a printed circuit board (PCB) and a plurality of LEDs each disposed on at least a face of the PCB, and a carbon nanoparticles which have hexagonal carbon ring geometry based heat dissipation film is disposed between each of the plurality of LEDs and the PCB.

In above embodiment, the light emitting body is a light source module having a printed circuit board (PCB) and a plurality of LEDs each disposed on at least a face of the PCB, and a carbon nanoparticles which have hexagonal carbon ring geometry based heat dissipation film is disposed on a bottom face of the PCB.

In above embodiment, the carbon nanoparticles which have hexagonal carbon ring geometry based heat dissipation unit are a hollow cap body.

In above embodiment, the carbon nanoparticles which have hexagonal carbon ring geometry based heat dissipation unit comprises a lamp cup and a carbon nanoparticles which have hexagonal carbon ring geometry based heat dissipation film being at least coated on a surface of the lamp cup.

In above embodiment, the lamp cup is a hollow cap body.

In above embodiment, the carbon nanoparticles which have hexagonal carbon ring geometry based heat dissipation film are coated on the surface and an internal face of the lamp cup.

BRIEF DESCRIPTIONS OF THE DRAWINGS

DESCRIPTION OF THE PREFERRED EMBODIMENTS

Figure 1:
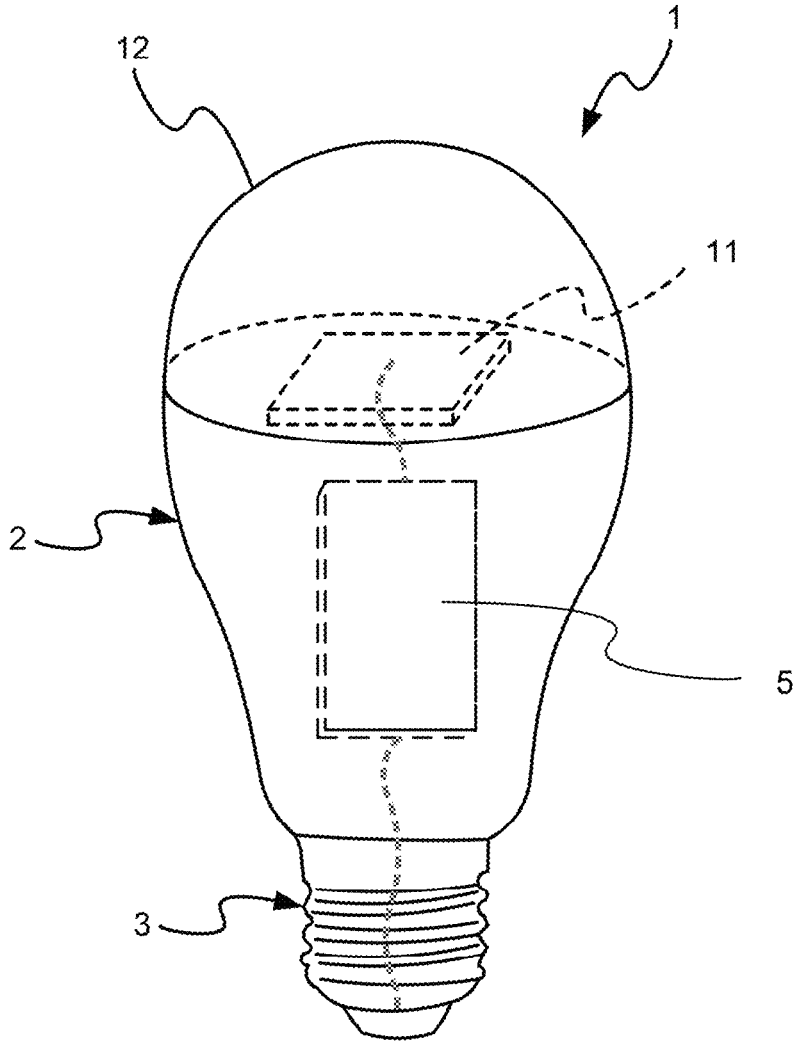
FIG. 1 is the structural view showing the schematic diagram of a first embodiment according to the present invention.
Figure 2:
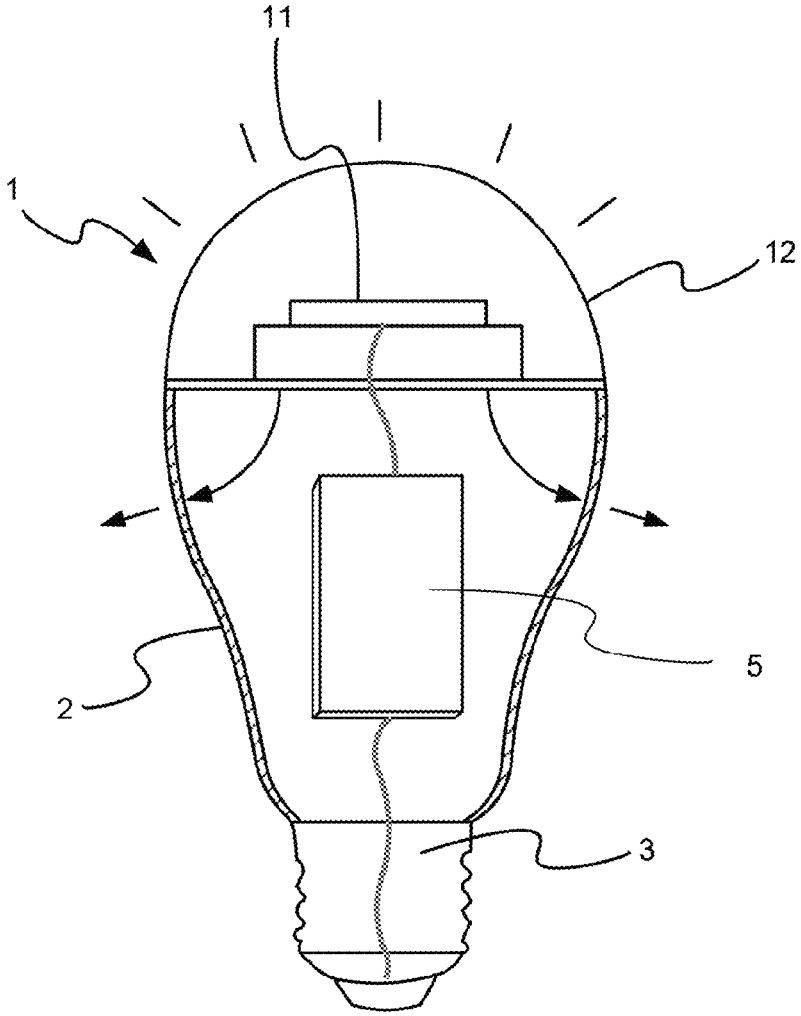
FIG. 2 is a cross sectional view showing the schematic diagram of the first embodiment according to the present invention.

Referring to FIG. 1 and FIG. 2, which are the structural view showing the schematic diagram of a first embodiment according to the present invention, and FIG. 2 is a cross sectional view showing the schematic diagram of the first embodiment according to the present invention, respectively. As shown, the present invention is a heat dissipation structure of lighting devices, which comprises a light emitting mechanism 1, a driver 5, a carbon nanoparticles which have hexagonal carbon ring geometry based heat dissipation unit 2 and a socket 3.

The mentioned light emitting mechanism 1 comprises a light emitting body 1 and a lampshade 12 enclosing the light emitting body 11. The light emitting body 11 is a light source module.

The carbon nanoparticles which have hexagonal carbon ring geometry based heat dissipation unit 2 is a hollow cap body, and combined with an end of the light emitting mechanism 1.

The socket 3 is electrically connected to the light emitting body 11 of the light emitting mechanism 1, and combined with an end of the carbon nanoparticles which have hexagonal carbon ring geometry based heat dissipation unit surface and an internal face of the lamp cup.

When the present invention is operated, an end of the socket 3 is combined with an associated lampholder (not shown), so that a power is required by lampholder for emitting a light which pass through a lampshade 12 by the light emitting body 11 of the light emitting mechanism 1. Further, since the light emitting body 11 generates a waste heat at the same time, a hexagonal carbon ringed nanometer carbon unit 2 can efficiently transfer the heat to ambient by heat source when the light emitting body 11 is operated, and avoiding a thermal transfer gap, whereby a thermal transmission efficiency is promoted. Therefore the thermal transfer bottleneck is effectively decreased. Heat sink is never necessary. Heat dissipation cost is largely reduced. Volume and weight of the device is also reduced. The waste of the raw material, carbon, and energy consumption may be reduced.

Figure 3:
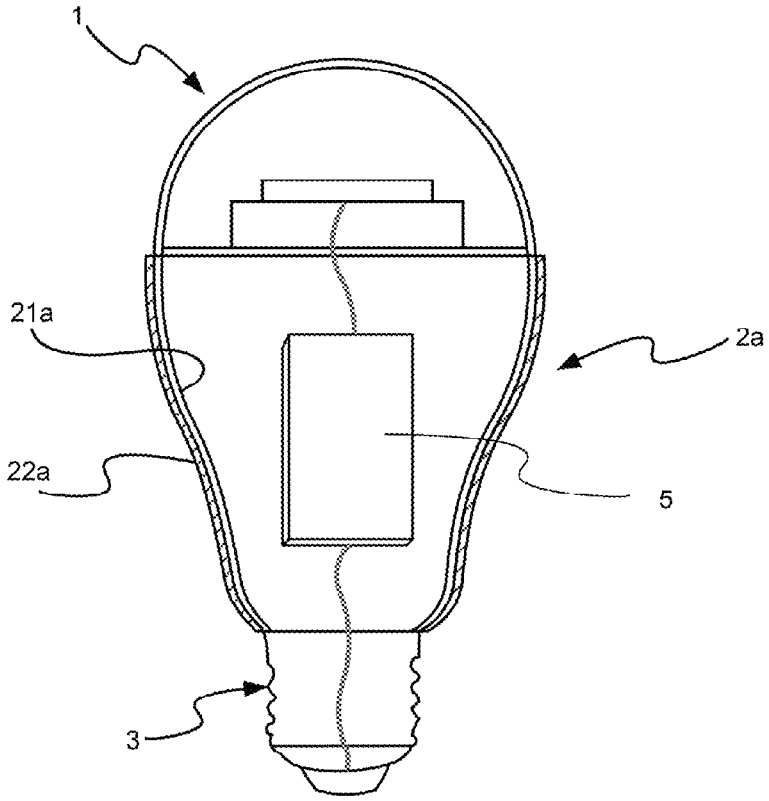
FIG. 3 is a cross sectional view showing the schematic diagram of a second embodiment according to the present invention.

Referring to FIG. 3, which is a cross sectional view showing the schematic diagram of a second embodiment according to the present Invention. As shown, the present invention may also have the structure of the second embodiment in addition to the structure of the first embodiment mentioned above. Between the second and first embodiments, there is the difference that the carbon nanoparticles which have hexagonal carbon ring geometry based heat dissipation unit 2*a* comprises a lamp cup 21*a* and a carbon nanoparticles which have hexagonal carbon ring geometry based heat dissipation film 22*a* are coated on a surface (or the surface and an internal face) of the lamp cup 21*a*, in which the lamp cup 21*a* is a hollow mask body. As such, the carbon nanoparticles which have hexagonal carbon ring geometry based heat dissipation film 2*a* and the light emitting mechanism 1 and the socket 3 can be combined for heat dissipation, whereby the present invention can further satisfy with a requirement for a practical use in addition for the above efficacy.

Figure 4:
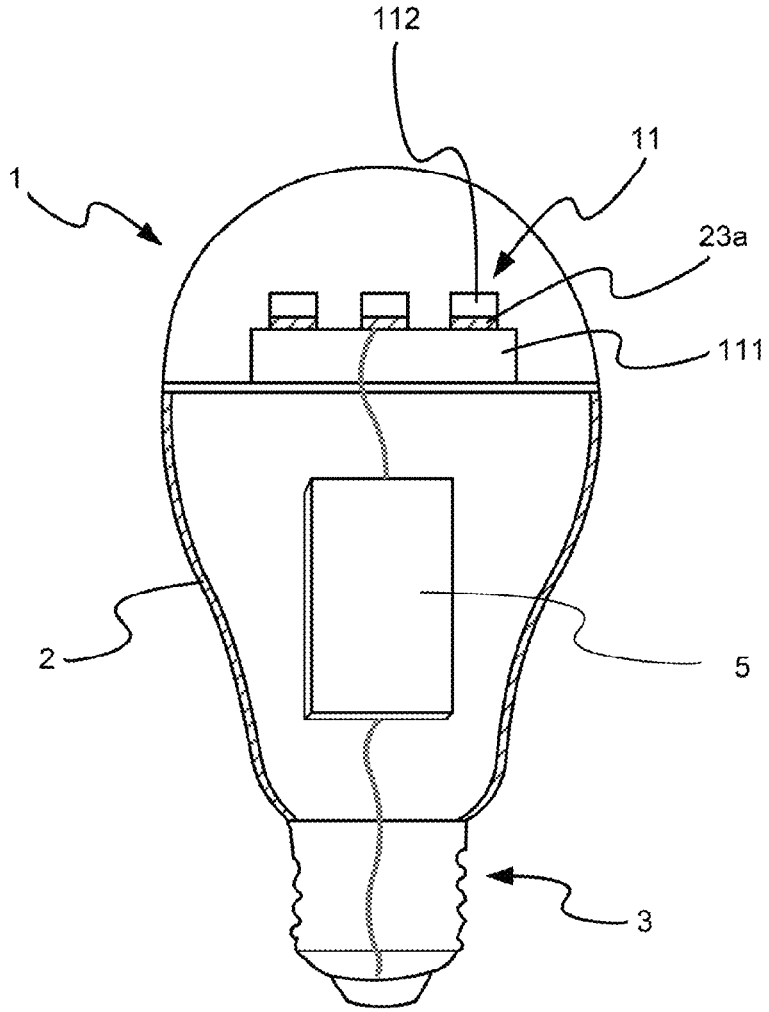
FIG. 4 is a cross sectional view showing the schematic diagram of a third embodiment according to the present invention.

Referring to FIG. 4, which is a cross sectional view showing the schematic diagram of a third embodiment according to the present invention. As shown, the present invention can further have the structure of the third embodiment except for the first embodiment, and the difference between the third and the first embodiments is that the light emitting body 11 is a printed circuit board (PCB) 111 and a light source module having a plurality of LEDs 112. Each of the plurality of LEDs is disposed on at least a face of the PCB 111. And, a carbon nanoparticles which have hexagonal carbon ring geometry based heat dissipation film 23*a* is further disposed between each of the LEDs and the PCB 111. As such, the present invention can satisfy a requirement for practical use.

In addition to that the carbon nanoparticles which have hexagonal carbon ring geometry based heat dissipation unit 2 and the light emitting mechanism 1 and the socket are combined for heat dissipation, the a carbon nanoparticles which have hexagonal carbon ring geometry based heat dissipation film 23*a* can further be utilized to dissipate the heat generated form the LEDs 112. As such, the present invention can further satisfy a requirement for a practical use.

Figure 5:
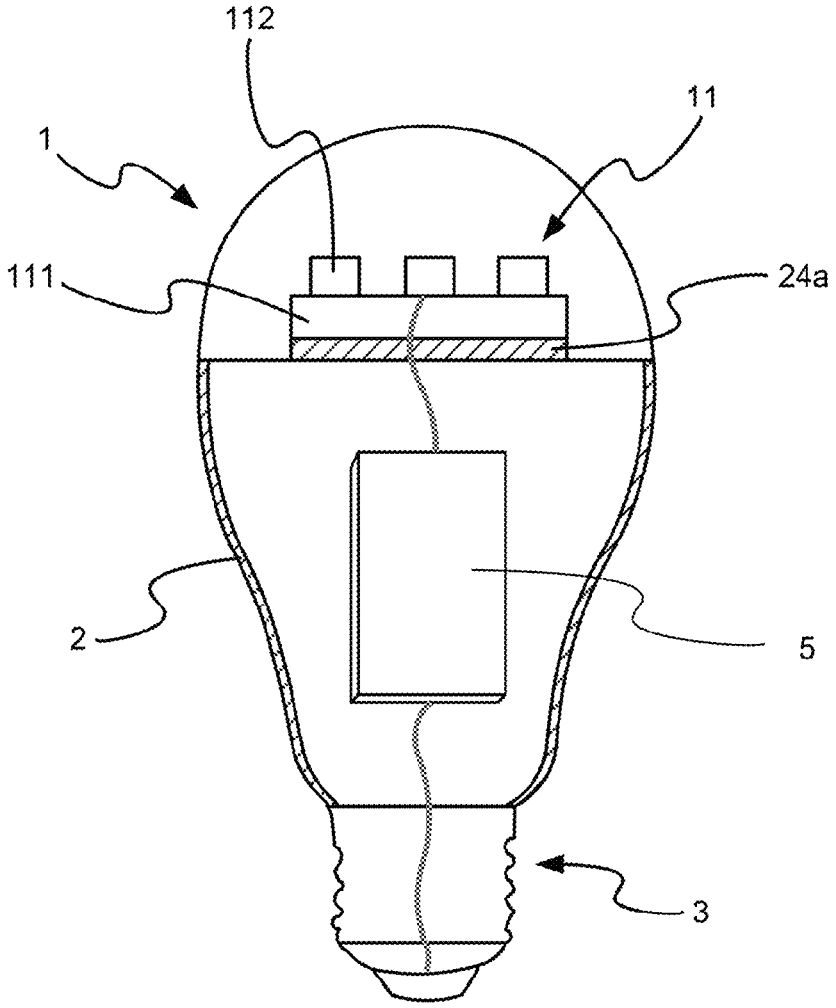
FIG. 5 is a cross sectional view showing the schematic diagram of a fourth embodiment according to the present invention.

Referring to FIG. 5, which is a cross sectional view showing the schematic diagram of a fourth embodiment according to the present invention. As shown, the present invention can further have the structure of the fourth embodiment except for the first embodiment, and the difference between the fourth and the first embodiments is that the light emitting body 11 is a PCB 111 and a light source module having a plurality of LEDs 112. Each of the plurality of LEDs is disposed on at least a face of the PCB 111. And, a carbon nanoparticles which have hexagonal carbon ring geometry based heat dissipation film 24*a* is further disposed a bottom face of the PCB 111. As such, besides that the carbon nanoparticles which have hexagonal carbon ring geometry based heat dissipation unit 2 is combined with the light emitting mechanism 1 and the socket 3 for heat dissipation, a carbon nanoparticles which have hexagonal carbon ring geometry based heat dissipation film 24*a* is also used to dissipate the heat source from the PCB 111. As such, the present invention can satisfy a requirement for practical use.

Figure 6:
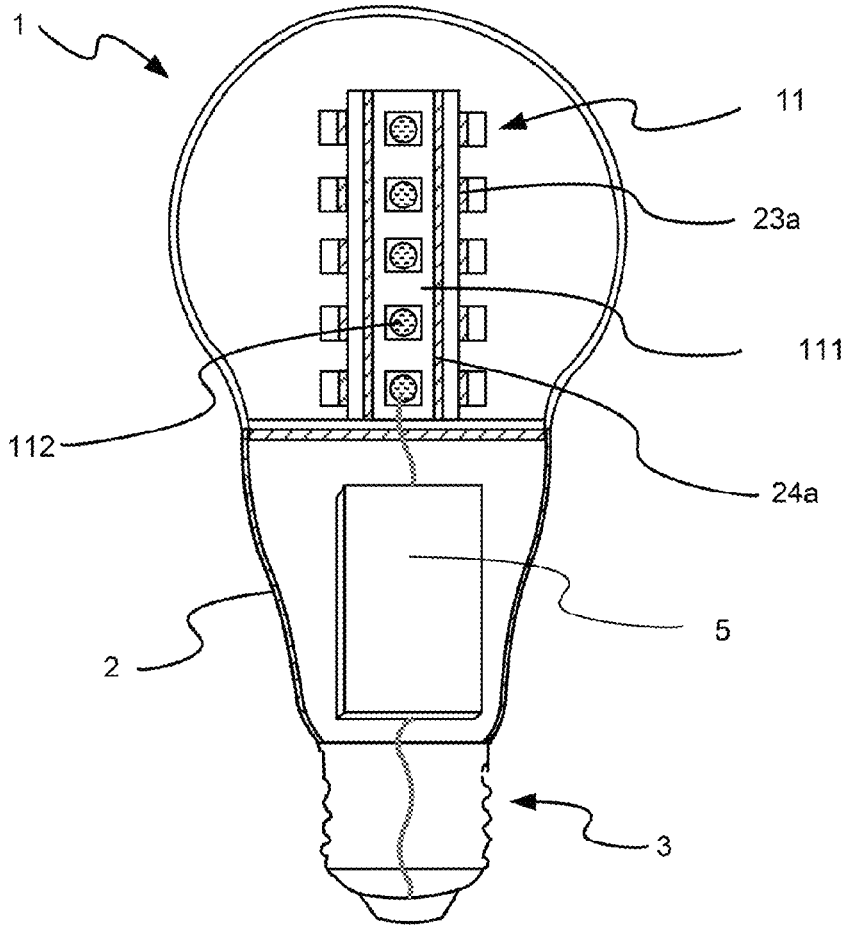
FIG. 6 is a cross sectional view showing the schematic diagram of the fifth embodiment according to the present invention.

Referring to FIG. 6, which is a cross sectional view showing the schematic diagram of a fifth embodiment according to the present invention. As shown, the present invention may further have the structure of the fifth embodiment except for the first embodiment, and the difference between the fifth and the first embodiments is that the light emitting body 11 is a PCB 111 and a light source module having a plurality of LEDs 112. Each of the plurality of LEDs is disposed on at least a face of the PCB 111. And, a carbon nanoparticles which have hexagonal carbon ring geometry based heat dissipation film 23*a* is further disposed between the LEDs 112 and the PCB 111. Further, a carbon nanoparticles which have hexagonal carbon ring geometry based heat dissipation film 24*a*. As such, besides that the carbon nanoparticles which have hexagonal carbon ring geometry based heat dissipation unit 2 is combined with the light emitting mechanism 1 and the socket 3 for heat dissipation, a carbon nanoparticles which have hexagonal carbon ring geometry based heat dissipation film 23*a* is also used to dissipate the heat source from the LEDs 112. And, a hexagonal carbon ringed nanometer carbon heat dissipating film 24*a* is used to dissipate the heat from the PCB 111. As such, the present invention can satisfy a requirement for practical use.

In view of the above, the heat dissipation structure of lighting devices may effectively improve the disadvantages encountered in the prior art, where a thermal transmission efficiency is promoted, a thermal transfer bottleneck is effectively decreased, heat sink can be not necessary, a heat dissipation cost is largely reduced, a volume and weight of the device is reduced, a consumption of the raw material is reduced, and a purpose of energy saving and carbon reduction is achieved.

The above described is merely examples and preferred embodiments of the present invention, and not exemplified to intend to limit the present invention. Any modifications and changes without departing from the scope of the spirit of the present invention are deemed as within the scope of the present invention. The scope of the present invention is to be interpreted with the scope as defined in the appended claims.

ELEMENT LABEL CONTRAPOSITION

1 light emitting mechanism
11 light emitting body
111 PCB

112 LEDs
12 lampshade
2、2*a* hexagonal carbon ringed nanometer heat dissipation unit
21*a* lamp cup
22*a*、23*a*、24*a* hexagonal carbon ringed nanometer heat dissipation film
3 socket
5 driver

The invention claimed is:

1. A heat dissipation structure of lighting devices, comprising:

a light emitting mechanism;

a driver;

a carbon nanoparticles which have hexagonal carbon ring geometry based heat dissipation unit, combined with an end of the light emitting mechanism; and a socket, electrically connected to the light emitting mechanism, and combined with an end of the carbon nanoparticles which have hexagonal carbon ring geometry based heat dissipation unit, wherein the light emitting mechanism comprises a light emitting body electrically connected to the socket through a driver, and a lampshade enclosing the light emitting body, wherein the light emitting body is a light source module having a printed circuit board (PCB) and a plurality of LEDs each disposed on at least a face of the PCB, and a carbon nanoparticles which have hexagonal carbon ring geometry based heat dissipation film is disposed between each of the plurality of LEDs and the PCB.

2. The heat dissipation structure of lighting devices as claimed in claim 1, wherein the carbon nanoparticles which have hexagonal carbon ring geometry based heat dissipation unit is a hollow cap body.

3. The heat dissipation structure of lighting devices as claimed in claim 1, wherein the carbon nanoparticles which have hexagonal carbon ring geometry based heat dissipation unit comprises a lamp cup and a carbon nanoparticles which have hexagonal carbon ring geometry based heat dissipation film being at least coated on a surface of the lamp cup.

4. The heat dissipation structure of lighting devices as claimed in claim 3, wherein the lamp cup is a hollow cap body.

5. The heat dissipation structure of lighting devices as claimed in claim 4, wherein the a carbon nanoparticles which have hexagonal carbon ring geometry based heat dissipation film is coated on the surface and an internal face of the lamp cup.

6. A heat dissipation structure of lighting devices, comprising:

a light emitting mechanism;

a driver;

a carbon nanoparticles which have hexagonal carbon ring geometry based heat dissipation unit, combined with an end of the light emitting mechanism; and a socket, electrically connected to the light emitting mechanism, and combined with an end of the carbon nanoparticles which have hexagonal carbon ring geometry based heat dissipation unit, wherein the light emitting mechanism comprises a light emitting body electrically connected to the socket through a driver, and a lampshade enclosing the light emitting body, wherein the light emitting body is a light source module having a printed circuit board (PCB) and a plurality of LEDs each disposed on at least a face of the PCB, and a carbon nanoparticles which have hexagonal carbon ring geometry based heat dissipation film is disposed on a bottom face of the PCB.

7. A heat dissipation structure of lighting devices, comprising:

a light emitting mechanism;

a driver;

a carbon nanoparticles which have hexagonal carbon ring geometry based heat dissipation unit, combined with an end of the light emitting mechanism; and a socket, electrically connected to the light emitting mechanism, and combined with an end of the carbon nanoparticles which have hexagonal carbon ring geometry based heat dissipation unit, wherein the light emitting mechanism comprises a light emitting body electrically connected to the socket through a driver, and a lampshade enclosing the light emitting body, wherein the light emitting body is a light source module, wherein the carbon nanoparticles which have hexagonal carbon ring geometry based heat dissipation unit is a hollow cap body.

* * * * *